US005515145A

United States Patent [19]

Sasaki et al.

[11] Patent Number: 5,515,145

[45] Date of Patent: May 7, 1996

[54] COLOR IMAGE FORMING APPARATUS HAVING INTEGRAL MULTIPLE LENGTH BELT

[75] Inventors: Eiichi Sasaki, Sagamihara; Koichi Noguchi, Tokyo; Minoru Suzuki, Yokohama; Koji Sakamoto, Tokyo; Hiroyuki Matsushiro, Yokohama; Tsuyoshi Deki; Noriyuki Kimura, both of Kawasaki; Takatsugu Fujishiro; Chiyako Hatsuyama, both of Tokyo, all of Japan

[73] Assignee: Ricoh Company, Ltd., Tokyo, Japan

[21] Appl. No.: 158,396

[22] Filed: Nov. 29, 1993

[30] Foreign Application Priority Data

Nov. 30, 1992 [JP] Japan ..... 4-320932

[51] Int. Cl.[6] ..... G03G 15/00

[52] U.S. Cl. ..... 355/271; 355/200; 347/153

[58] Field of Search ..... 355/200, 271, 355/274, 326 R, 327; 346/157; 347/116, 153, 154

[56] References Cited

U.S. PATENT DOCUMENTS 4,847,660 11/1989 Wheatley, Jr. et al. ..... 355/326 R X 5,314,774 5/1994 Camis ..... 355/274 X

FOREIGN PATENT DOCUMENTS 5-297726 11/1993 Japan ..... 355/271

*Primary Examiner*—Joan H. Pendegras

*Attorney, Agent, or Firm*—Oblon, Spivak, McClelland, Maier, & Neustadt

[57] ABSTRACT

A color image forming apparatus of the type having a photoconductive belt for forming a latent image thereon electrostatically. The latent image is developed to turn out a corresponding toner image. The toner image is transferred from the photoconductive belt to an intermediate transfer belt. Such a procedure is repeated to form a composite color image on the intermediate belt. The color image is transferred from the intermediate belt to a recording medium. Any point on the intermediate belt in the direction of rotation and any points on drive rollers assigned to the two belts, respectively, in the direction of rotation are held in the same positional relation to a stationary member every time the intermediate belt completes one rotation.

8 Claims, 8 Drawing Sheets

COLOR IMAGE FORMING APPARATUS HAVING INTEGRAL MULTIPLE LENGTH BELT

BACKGROUND OF THE INVENTION

The present invention relates to a color copier, color printer, color facsimile apparatus or similar color image forming apparatus.

Conventional color image forming apparatuses include one having a photoconductive belt, latent image forming means for forming latent images each being representative of an image of particular color on the belt electrostatically, a developing unit for developing each latent image with a developer of corresponding color. and an intermediate transfer belt to which the developed images are transferred from the photoconductive belt one above the other. The resulting composite image formed on the intermediate transfer belt is transferred to and fixed on a paper or similar recording medium to complete a color image. This type of image forming apparatus is disclosed in, for example, Japanese Patent Laid-Open Publication (Kokai) No. 182766/1987. However, the problem with such an apparatus is that drive rollers for driving the photoconductive belt and intermediate transfer belt are often eccentric. The eccentricity of the drive rollers prevent the images of different colors from being brought into accurate register with each other.

SUMMARY OF THE INVENTION

It is, therefore. an object of the present invention to provide a color image forming apparatus capable of eliminating the displacement of colors ascribable to the eccentricity of drive rollers.

In accordance with the present invention, a color image forming apparatus comprises a photoconductive belt, a latent image forming section forming latent images each being representative of an image of particular color electrostatically on the photoconductive belt, a developing section for developing each of the latent images with a developer of particular color to thereby produce a corresponding visible image, an intermediate transfer belt to which the visible images of respective colors are transferred from the photoconductive belt one above the other, and a drive transmission system comprising a first drive roller for driving the photoconductive belt, and a second drive roller for driving the intermediate transfer belt. The intermediate transfer belt has a circumferential length which is an integral multiple of the circumferential length of the second drive roller. The circumferential length of the second drive roller is an integral multiple of the circumferential length of the first drive roller.

Also, in accordance with the present invention, a color image forming apparatus comprises a photoconductive belt, a latent image forming section for forming latent images each being representative of an image of particular color electrostatically on the photoconductive belt, a developing section for developing each of the latent images with a developer of particular color to thereby produce a corresponding visible image, an intermediate transfer belt to which the visible images of respective colors are transferred from the photoconductive belt one above the other, and a drive transmission system comprising a first drive roller for driving the photoconductive belt, and a second drive roller for driving the intermediate transfer belt. The intermediate transfer belt has a circumferential length which is an integral multiple of the circumferential length of the second drive roller. The circumferential length of the second drive roller is an integral multiple of the circumferential length of the first drive roller. The visible images are transferred from the photoconductive belt to the intermediate transfer belt at a first transfer position and from the intermediate transfer belt to a recording medium at a second transfer position. The distance from the first transfer position to the second transfer position as measured on the intermediate transfer belt is greater than the maximum print size.

Further. in accordance with the present invention, a color image forming apparatus comprises a photoconductive belt, a latent image forming section for forming latent images each being representative of an image of particular color electrostatically on the photoconductive belt, a developing section for developing each of the latent images with a developer of particular color to thereby produce a corresponding visible image, an intermediate transfer belt to which the visible images of respective colors are transferred from the photoconductive belt one above the other, and a drive transmission system comprising a first drive roller for driving the photoconductive belt, and a second drive roller for driving the intermediate transfer belt. The intermediate transfer belt has a circumferential length which is an integral multiple of the circumferential length of the second drive roller. The circumferential length of the second drive roller is an integral multiple of the circumferential length of the first drive roller. The intermediate transfer belt is provided with position information for determining the time for forming the latent image on the photoconductive belt. A sensor is provided for sensing the position information.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
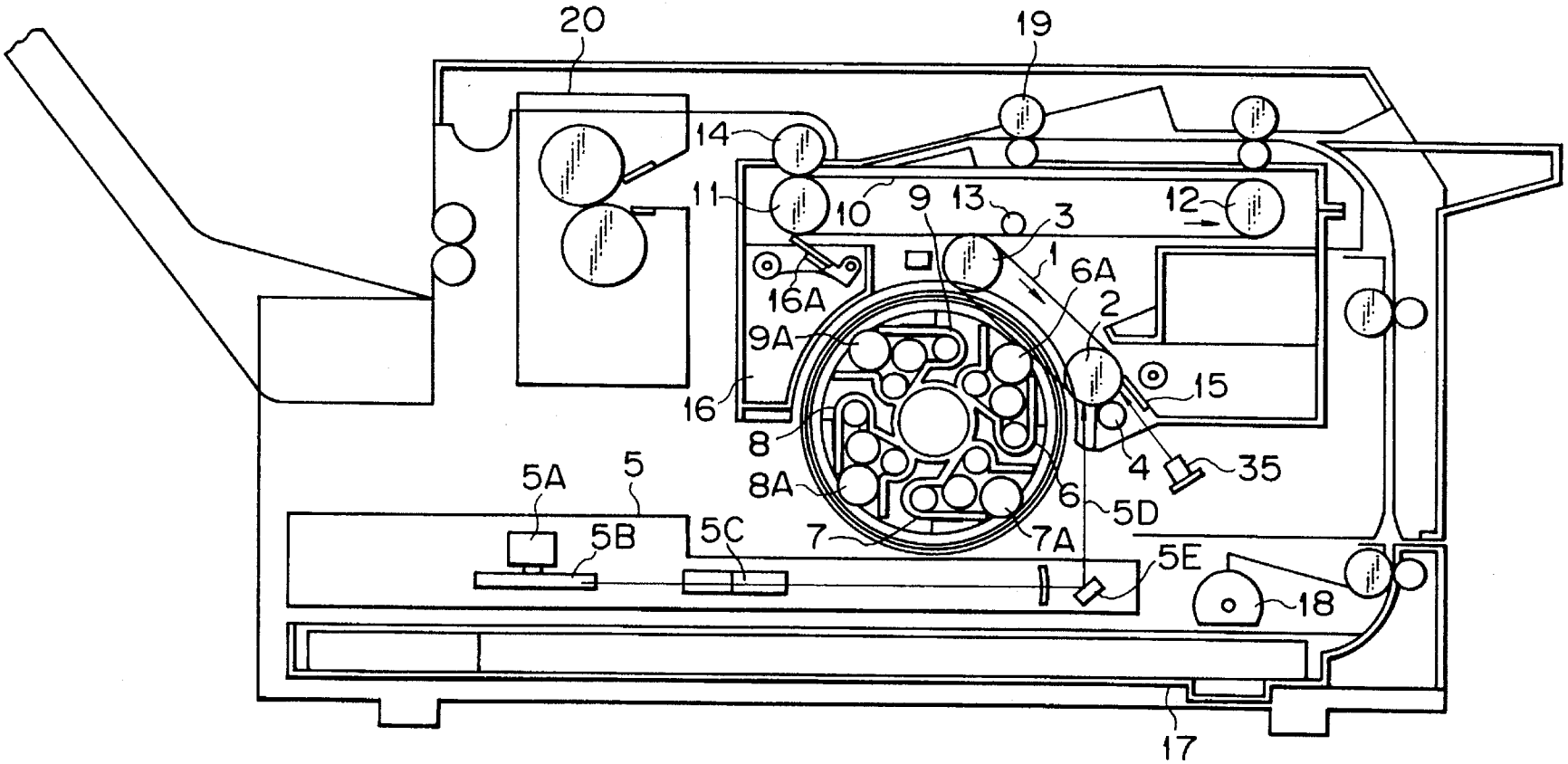
FIG. 1 is a section showing a color image forming apparatus embodying the present invention.

Referring to FIG. 1 of the drawings, a color image forming apparatus embodying the present invention is shown and implemented as a color copier by way of example. As shown, the color copier has a photoconductive element in the form of a flexible endless belt 1. The belt 1 is passed over a drive roller 3 and a driven roller 2 and rotated clockwise as viewed in the figure. A charging member 4 is positioned in close proximity to the roller 2 and used to uniformly charge the surface of the belt 1 before a latent image is electrostatically formed thereon. A laser writing unit, or exposing means. 5 includes a drive motor 5A, a polygon mirror 5B, an f-theta lens 5C. and a mirror 5E. The writing unit 5 is accommodated in a casing which has a slit for exposure on the top thereof. The casing is disposed in the copier body such that a laser beam 5D issuing from the writing unit 5 is incident on the part of the belt 1 passed over the roller 2. If desired. the laser writing unit 5 may be replaced with optics having a light emitting portion and a converging light transmitting member constructed integrally with each other. A cleaning unit 15 is also located in close proximity to the roller 2 in order to clean the surface of the belt 1. The charging member 4 and writing unit 5 constitute a specific form of latent image forming means for forming a latent image on the belt 1 electrostatically.

A revolver type developing unit, or developing means, has developing sections 6–9 storing respectively a yellow developer, a magenta developer, a cyan developer, and a black developer. The developing sections 6–9 each develops a particular latent image with the developer, thereby allowing a color image to be formed. The developing sections 6–9 have respectively developing sleeves 6A–9A which are selectively movable to a predetermined position where they adjoin or contact the belt 1. The developing sections 6–9 each converts a latent image formed on the belt 1 by the laser beam 5D to a corresponding toner image by non-contact development (or contact development).

The toner images formed on the belt 1 by the developing sections 6–9 are sequentially transferred to an intermediate transfer belt 10 one above the other, as will be described specifically later. The intermediate transfer belt 10 is passed over a drive roller 11 and a driven roller 12 and rotatable counterclockwise as viewed in the figure. The belt 1 contacts the belt 10 at a portion thereof passed over the drive roller 3. A bias roller 13 is disposed between the opposite runs of the intermediate belt 10. As the first or cyan toner image is formed on the belt, it is transferred to the intermediate belt 10 by the bias roller 13. This procedure is repeated to sequentially transfer the second or magenta toner image, the third or yellow toner image and the fourth or black toner image to the intermediate belt 10 one above the other, thereby forming a full color image on the belt 10. A transfer roller 14 is positioned above the left end of the intermediate belt 10. as viewed in the figure, and faces the drive roller 11. The transfer roller 14 is movable into and out of contact with the intermediate belt 10. When a recording medium. e.g., a paper is brought to and conveyed by the transfer roller 14. the full color image is transferred from the belt 10 to the paper. A cleaning unit 16 is associated with the intermediate belt 10 and includes a blade 16A. While image formation is under way, the blade 16A is spaced apart from the surface of the belt 10; after the image transfer, it is pressed against the belt 10 to clean the surface thereof, as illustrated.

Also shown in FIG. 1 are a paper support or paper feeding means 17, a pick-up roller 18, a registration roller 19, a fixing unit 20, and a discharging roller 35.

In operation, a scanner, not shown, reads an original document and generates image data representative of the document. Specifically, an imaging device included in the scanner generates image data representative of the document. The image data is routed through an image data input section to an image data processing section. The image data processing section executes various kinds of conventional processing. The processed image data is once written to a video memory. In the event of recording, the image data is read out of the video memory and delivered to the laser writing unit 5 which includes a semiconductor laser. In response, the semiconductor laser emits a laser beam representative of the image data. At this instant, the polygon mirror 5B is rotated by the drive motor 5A. The laser beam is steered by the polygon mirror 5B and propagated through the f-theta lens 5C to the mirror 5E. The laser beam, labeled 5D, from the mirror 5E is incident to the belt 1 whose surface has been uniformly charged by the charging member 4 beforehand. As a result, a latent image is electrostatically formed on the surface of the belt 1.

Specifically. a monocolor image pattern produced by separating a desired full color image into yellow, magenta, cyan and black components is incident on the belt 1. Such image patterns are sequentially formed on the belt 1. Each latent image formed on the belt 1 is developed by one of the developing sections 6–9 storing a developer of corresponding color, whereby a monocolor toner image is formed on the belt 1. At the position where the drive roller 3 is located, the toner image is transferred from the belt 1 to the intermediate belt 10 which is rotating counterclockwise in contact with the belt 1. The yellow, magenta, cyan and black toner images formed on the belt 1 one after another are sequentially transferred to the intermediate belt 10 in register with each other, thereby completing a full color image. As a paper is transported from the paper support 17 to the transfer roller, or image transfer position, 14 via the pick-up roller 18 and register roller 19, the full color image is transferred from the intermediate belt 10 to the paper by the roller 14. Subsequently, the full color image on the paper is fixed by the fixing unit 20.

Figure 2:
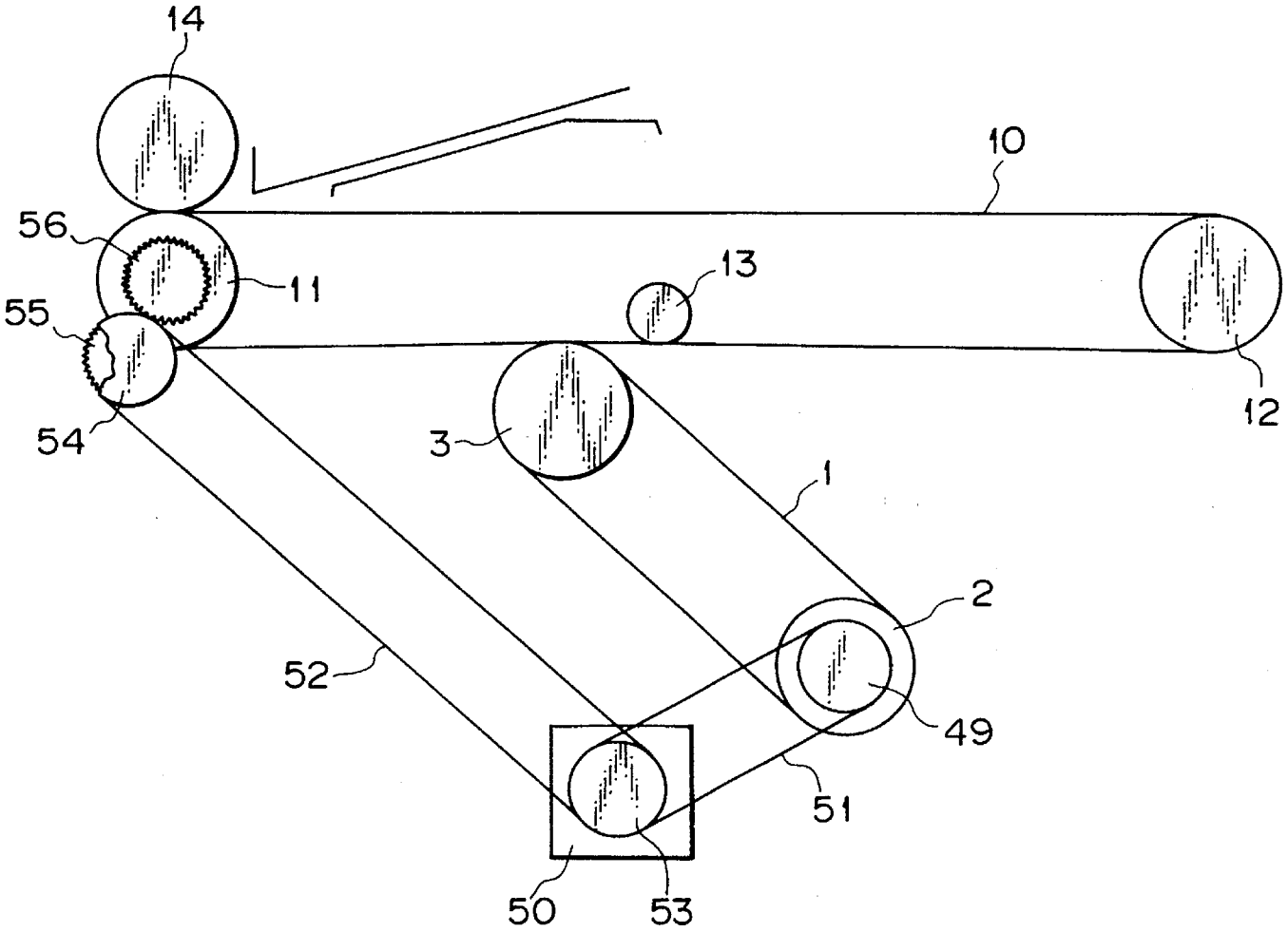
FIG. 2 is a view showing a specific drive transmission system included in the embodiment.

FIG. 2 shows a specific drive transmission system applicable to the color copier described above. Both the belt 1 and the intermediate belt 10 are implemented as a seamless belt. The drive transmission system includes a drive motor 50 and a pulley 53 mounted on the output shaft of the motor 50. A drive belt 51 is passed over the pulley 53 and a pulley 49 mounted on the shaft of the drive roller 2. Another drive belt 52 is passed over the pulley 53 and an intermediate pulley 54 which is used to drive the intermediate belt 10. A gear 55 is mounted on the same shaft as the intermediate pulley 54 and rotatable integrally with the pulley 54. A gear 56 is mounted on the same shaft as the drive roller 11 and held in mesh with the gear 55. In this configuration, the belts 1 and 10 are driven by a common drive source, i.e., motor 50. This is successful in matching the belts 1 and 10 in respect of the phase of irregular rotation speed and, therefore, in enhancing the accurate registration of a plurality of toner images. Further, since the point of drive transmission to the belt 1 is closer to the drive source than the point of drive transmission to the belt 10, the belt 1 is free from jitter or similar defects.

Figure 3:
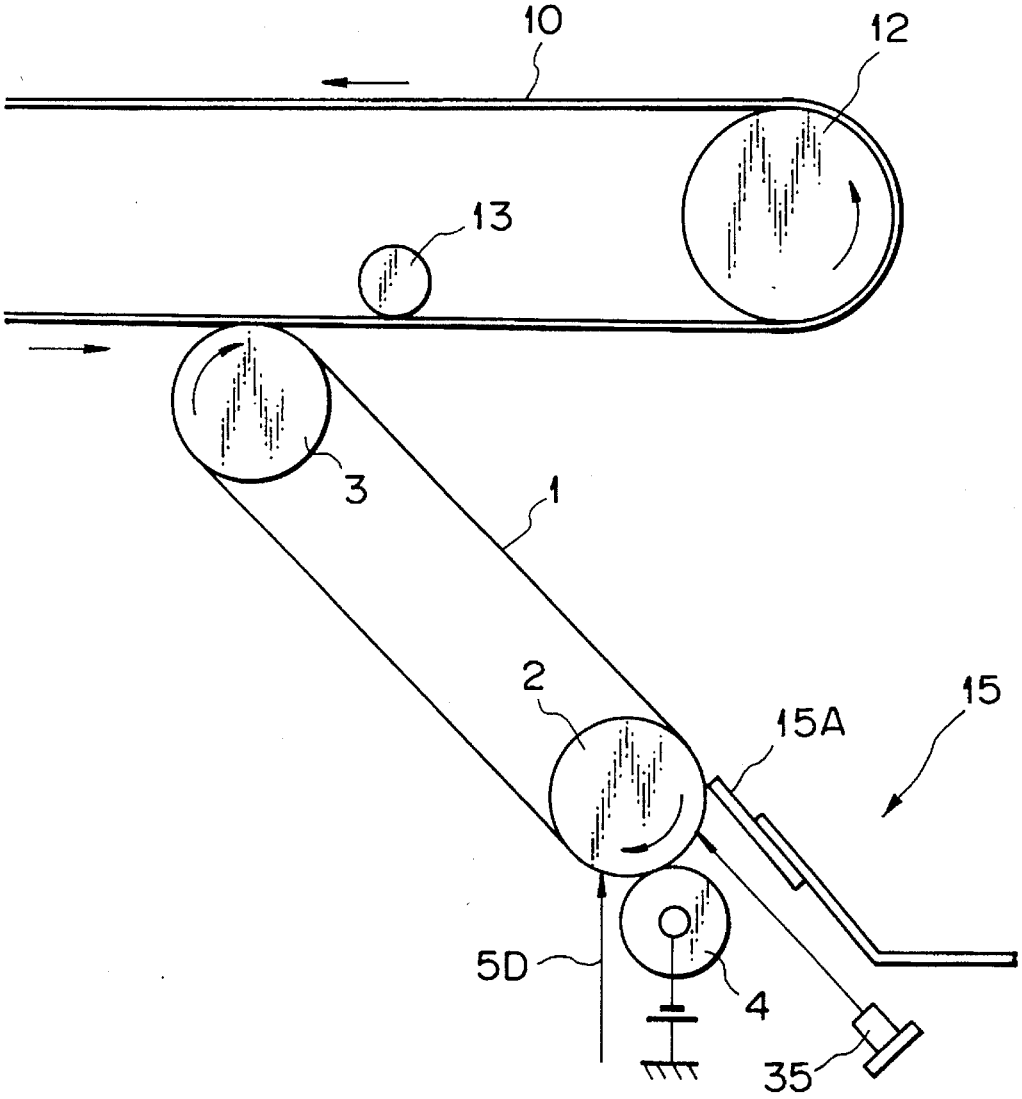
FIG. 3 shows an arrangement around a drive roller included in the embodiment and assigned to a photoconductive belt.

As shown in FIG. 3. the cleaning unit 15 has a cleaning blade 15A. The blade 15A and charging member 4, as well as a lamp 35 for discharging the surface of the belt, are associated with the driven roller 2.

The intermediate belt 10 has a circumferential length Ltb which is an integral multiple of the circumferential length Lbr of the drive roller 11; Ltb/Lbr is "6". Hence, every time the belt 10 rotates n rotations (n being a positive integer), any point P10 on the belt 10 and any point P11 on the roller 11 each corresponds to the same point of a stationary member. Specifically. every time the belt 10 rotates one rotation, a given point on the roller 11 corresponding to a given point on the belt 10 remains constant. Therefore, although roller 11 may be eccentric, the eccentricity does not cause the transfer start point on the belt 10 to change.

On the other hand, the photoconductive belt 1 and the drive roller 3 have circumferential lengths Lkb and Lbk, respectively; Lkb is equal to C·Lbk (C being a constant). In this case, the length Lkb of the belt 1 does not have to be an integral multiple of the length Lbk of the roller 3 since images are not superposed on the belt 1. However, when the belt 1 has a seam. it should be provided with a length which is an integral multiple of the length of the roller 3, since forming an image on the seam is not desirable.

In the illustrative embodiment, the circumferential length Lbr of the drive roller 11 is an integral multiple of the circumferential length Lbk of the drive roller 3. Hence, every time the roller 11 rotates N rotations. any point P11 on the roller 11 and any point P3 on the roller 3 each corresponds to the same point of a stationary member. It follows that every time the intermediate belt 10 rotates n rotations, the same positions of the rollers 3 and 11 face the same positions of a stationary member. Consequently, even when the rollers 3 and 11 are eccentric, the eccentricity does not result in the displacement of the images of different colors on the belt 10.

Further, the writing unit 5 writes images on the belt 1 at a pitch of Lwr. The pitch Lwr is related to the circumferential lengths Ltb and Lkb of the belts 10 and 1 as Ltb=A·Lwr and Lkb=B·Lwr (A and B being constants); that is, each of the lengths Lkb and Ltb is an integral multiple of the pitch Lwr. Therefore. even when the belts 1 and 10 rotate some rotations, their eccentricity does not effect the image transfer position. This allows a plurality of images to be written and superposed accuracy.

Figure 4:
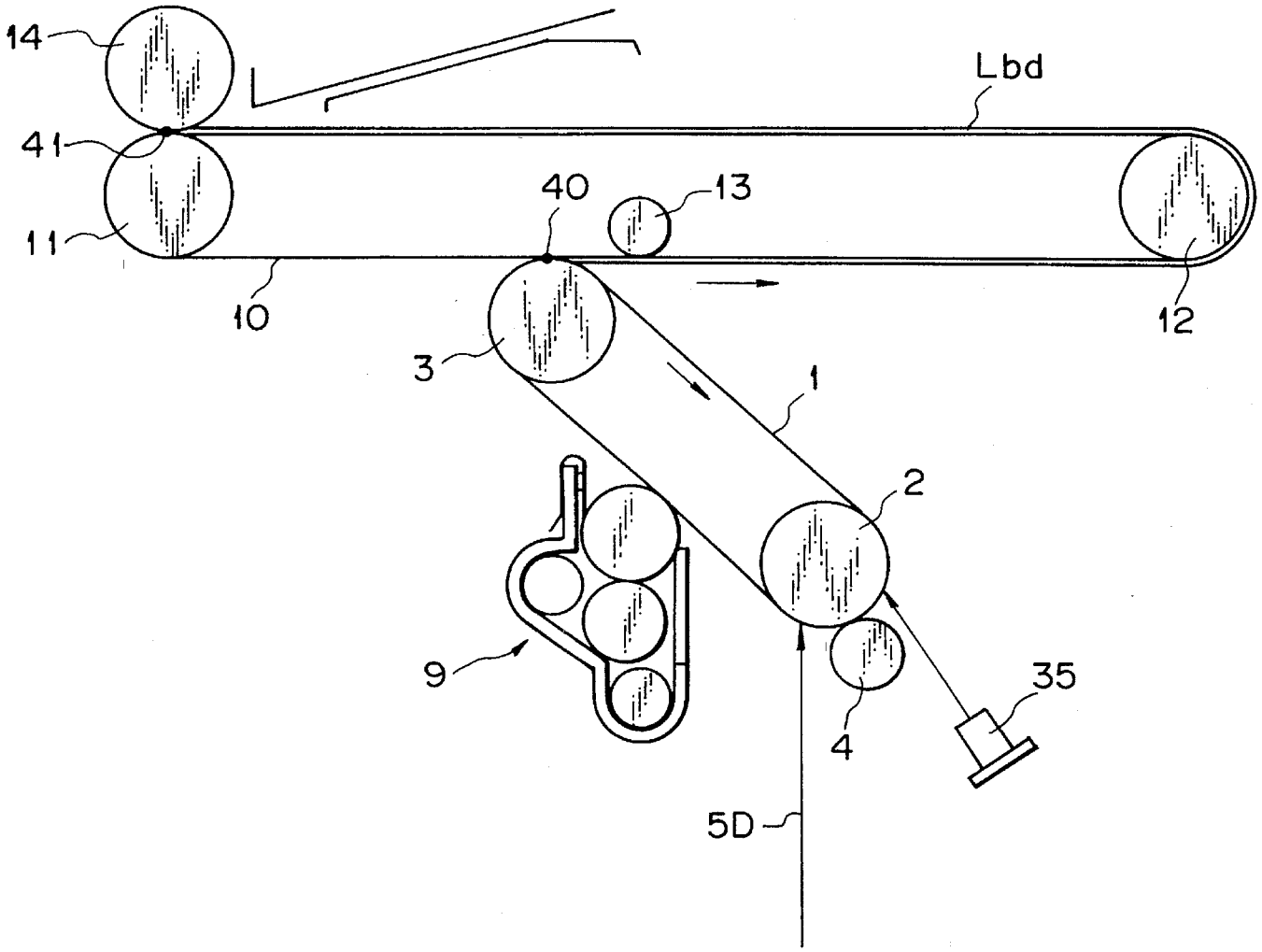
FIG. 4 is a view representative of a relation between an intermediate transfer belt included in the embodiment and the maximum print size available with the embodiment.
Figure 5:
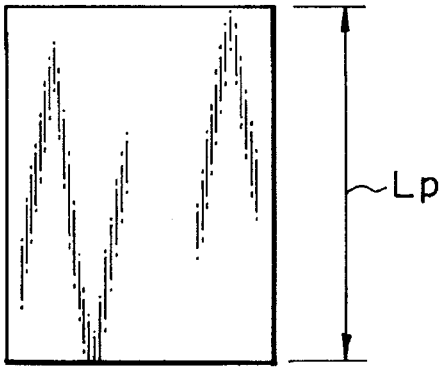
FIG. 5 shows the maximum print size.

Referring to FIG. 4, the belts 1 and 10 contact each other at a first transfer position 40 while a full color image formed on the belt 10 is transferred to a paper at a second transfer position 41. The distance Lbd from the first transfer position 40 to the second transfer position as measured on the belt 10 (indicated by a thick line in FIG. 4) is greater than the maximum print size Lp, FIG. 5, in the intended direction of paper transport. Hence, the last image transfer from the belt 1 to the belt 10 is effected after a single entire frame size has been completed. It follows that even when the torque acting on the belt 10 changes due to the contact of the paper and/or the transfer roller 14 with the belt 10, the image transfer from the belt 1 to the belt 10 has already been completed then. This frees the resulting image from the influence of the change in the rotation speed of the belt 10.

Figure 6:
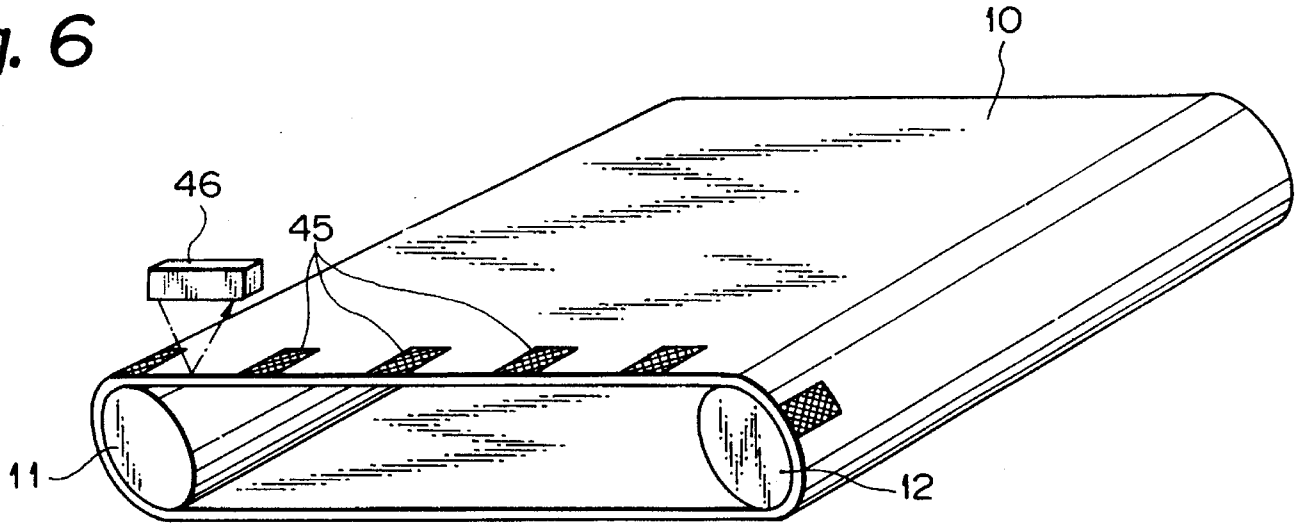
FIG. 6 is a perspective view showing position information provided on the intermediate transfer belt.

As shown in FIG. 6. a plurality of marks, or position information, 45 are printed on one edge of the intermediate belt 10. In practice, ten white marks 45 are provided at substantially equally spaced locations along one edge of the belt 10. The pitch of the marks 45 does not have to be accurate since any one of the marks 45 may be used as a reference. With the marks 45, it is possible to select a point for starting forming a latent image, i.e., a write start point with greater freedom. A sensor 46 senses the marks 45 of the belt 10 and may be implemented as a reflection type photointerrupter. The sensor 46 is mounted on a stationary member, not shown, and located above the portion of the belt 10 which contacts the drive roller 11. The marks 45 of the belt 10 sequentially face the sensor 46 as the belt 10 is rotated. Since the sensor 46 is located to face the drive roller 11, it can sense the marks 45 with accuracy although the belt 11 may oscillate due to slacking.

Figure 7:
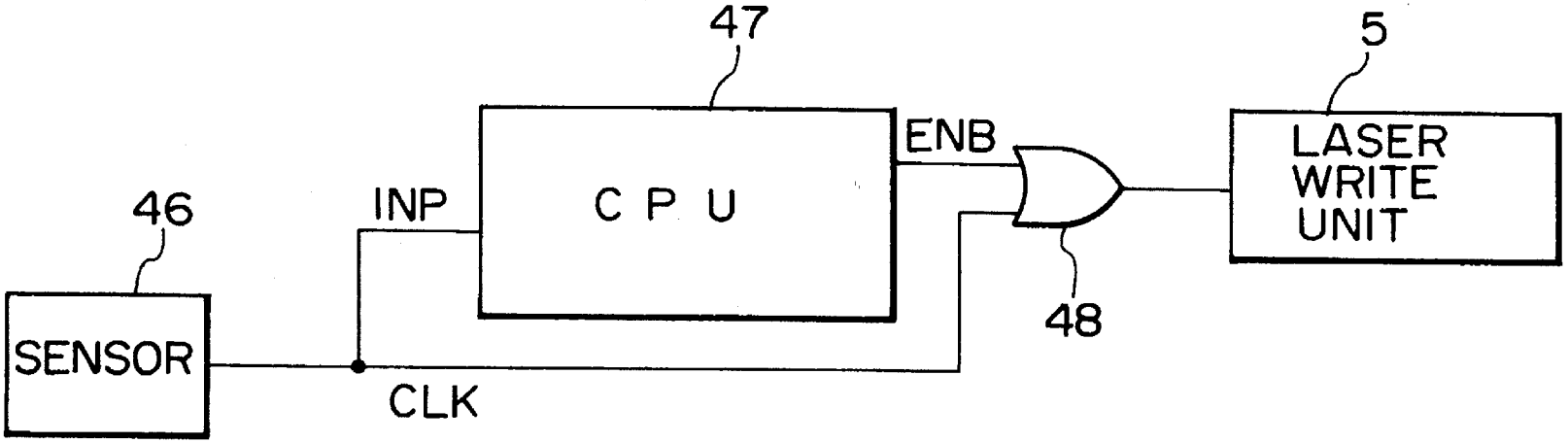
FIG. 7 is a block diagram schematically showing control means included in the embodiment for causing an image to be written.

As shown in FIG. 7, the output of the sensor 46 responsive to the marks 45 is sent to a CPU (Central Processing Unit) 47 which executes sequence control and includes a down-counter. The sensor output serves as a clock for the down-counter which counts the marks of the belt 10. By referencing the content of the down-counter, the CPU 47 outputs a write enable signal ENB for starting writing an image. The signal ENB is applied to an OR gate 48 together with the output of the sensor 46. The resulting output of the gate 48 is sent to the laser writing unit 5 as a write start signal. The CPU 47 further includes storing means for storing the number of marks 45. and discriminating means for determining whether or not the current marks are the marks detected by counting means for the first time.

Figure 8:
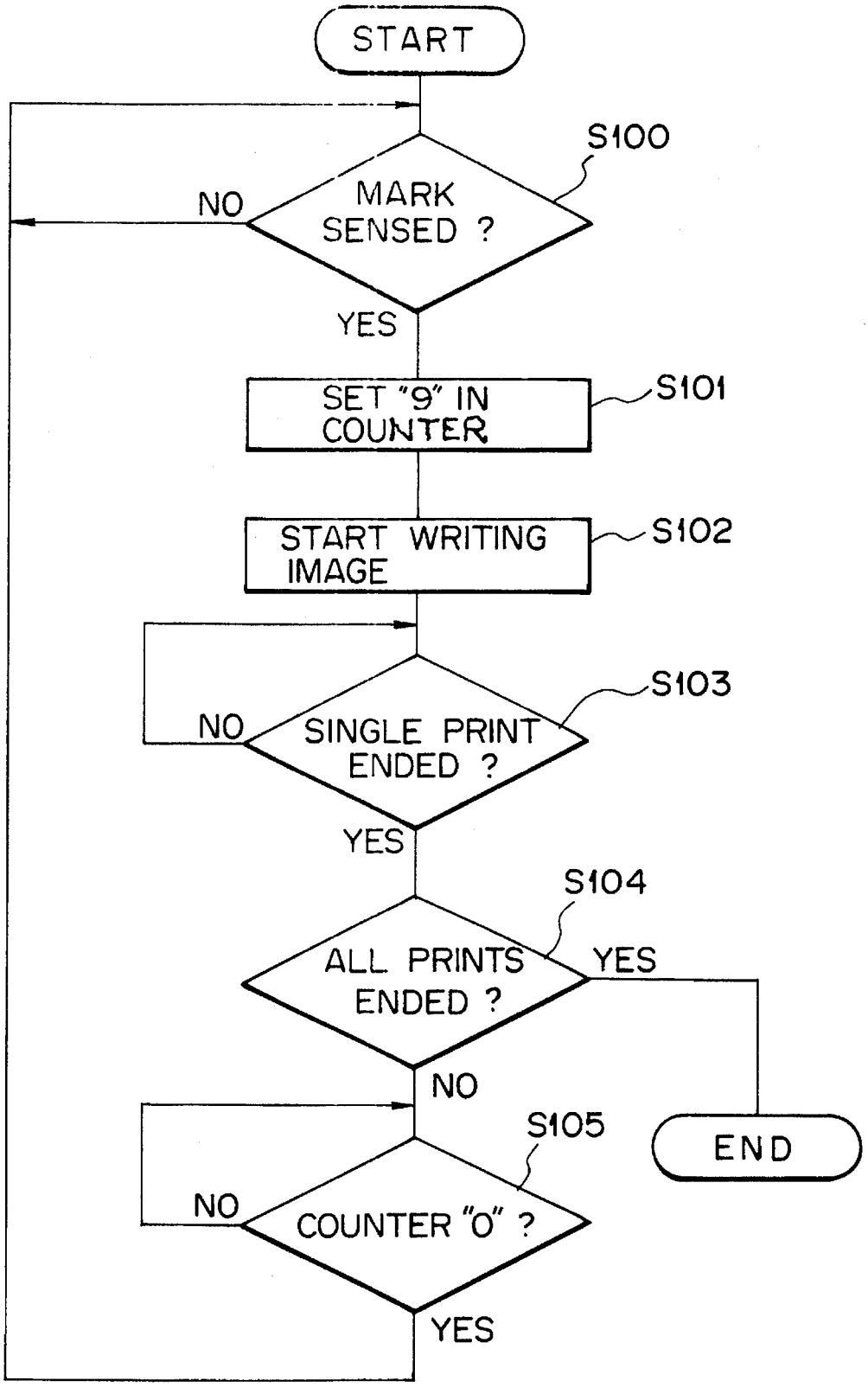
FIGS. 8 and 9 are flowcharts demonstrating a specific write control procedure particular to the embodiment.

A reference will be made to FIGS. 8 and 9 for describing a specific operation of the CPU 47. As shown in FIG. 8, assume that the color copier is ready to form an image, i.e., it is in a so-called print enable state. Then. the CPU 47 determines whether or not the sensor 46 has sensed a mark 5 (step S100). If the answer of the step S100 is negative, NO, the program returns to the step S100. This is repeated until the sensor 46 senses a mark 45. Of course, the write enable signal ENB is held in a low level while no marks 45 are sensed. When the sensor 46 senses a mark 45, the CPU 47 decrements the counting means thereof to "9" (step S101). At the same time, a laser write start signal is sent to the laser writing unit 5 (step S102). Therefore, the CPU 47 starts causing a latent image to be formed on the belt 1 in response to a mark 45 which the sensor 46 senses in the shortest period of time after the print enable state has been set up. Subsequently, the CPU 47 determines whether or not a single print corresponding to an image of one color has completed (step S103). This step S103 is repeated until a single print completes. If the answer of the step S103 is positive, YES, the CPU 47 determines whether or not all the prints corresponding to the images of four different colors have been fully written (step S104). If they have been fully written (YES, step S104), the program ends; if otherwise, the CPU 47 determines whether or not the counter has been decremented to "0" (step S105). If the counter is not "0" (NO, S105), the CPU 47 repeats the step S105. As soon as the counter reaches "0", the program returns to the step S100.

Figure 9:
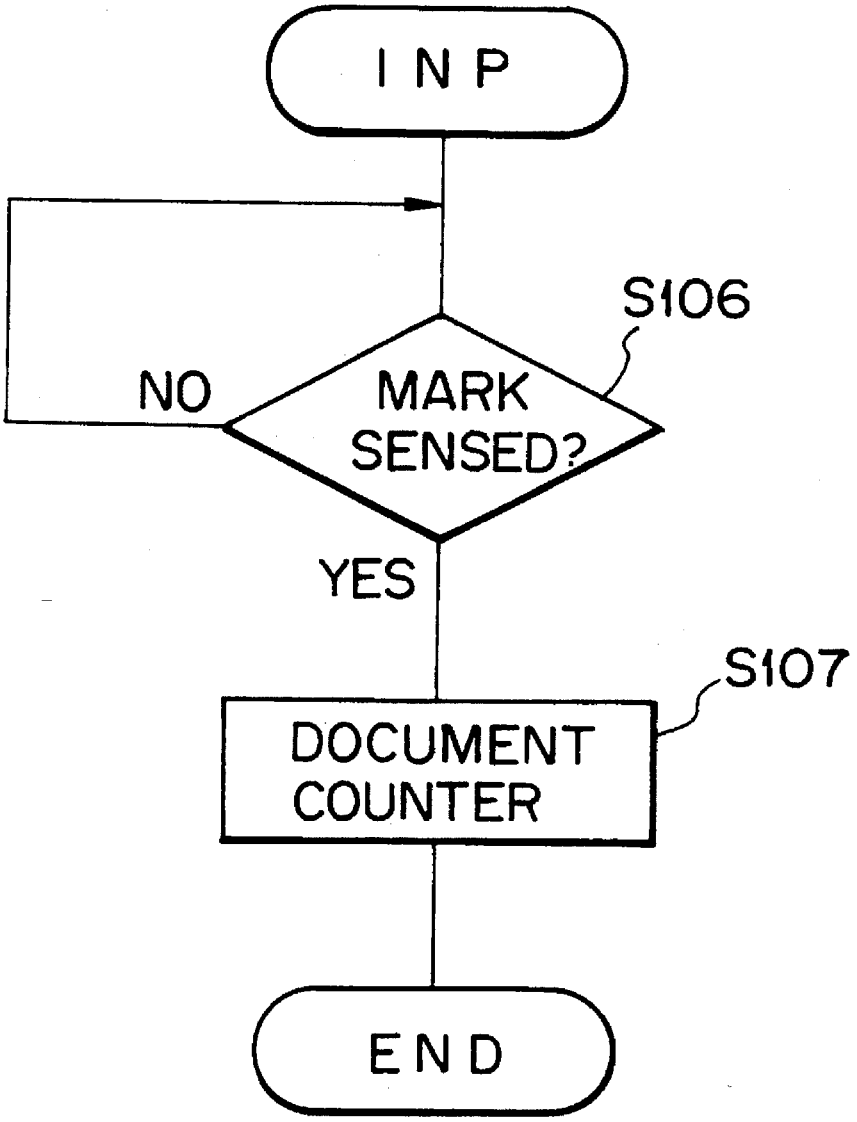

FIG. 9 shows an interrupt routine which the CPU 47 executes to see if a single print has completed or not by determining whether or not the down-counter is "0". As shown, every time a mark 45 is sensed (step S106), the CPU 47 decrements the down-counter (step S107) by 1 (one).

As stated above, the CPU 47 starts causing a latent image to be formed in response to a mark 45 sensed in the shortest period of time after the print enable state has been set up. This reduces the interval between the time when the print enable state is set up and the time when the formation of a latent image actually begins. Moreover, with the sensor 46, it is possible to discriminate the marks 45 detected for the first time from the others. Hence, a plurality of toner images can be superposed accurately if any one of the marks 45 of the belt 10 is used as a reference for starting forming a latent image. In addition, if the distance between nearby marks 45 is smaller than the maximum print size, the entire area of the belt 10 can be used effectively.

In summary. it will be seen that the present invention provides a color image forming apparatus free from the deviation of colors ascribable to the eccentricity of drive rollers.

Various modifications will become possible for those skilled in the art after receiving the teachings of the present disclosure without departing from the scope thereof.

What is claimed is:

1. A color image forming apparatus comprising:

a photoconductive belt;

latent image forming means for forming latent images each being representative of an image of particular color electrostatically on said photoconductive belt;

developing means for developing each of the latent images with a developer of particular color to thereby produce a corresponding visible image;

an intermediate transfer belt to which the visible images of respective colors are transferred from said photoconductive belt one above the other; and a drive transmission system comprising a first drive roller for driving said photoconductive belt, and a second drive roller for driving said intermediate transfer belt;

said intermediate transfer belt having a circumferential length which is an integral multiple of a circumferential length of said second drive roller, said circumferential length of said second drive roller being an integral multiple of a circumferential length of said first drive roller.

2. An apparatus as claimed in claim 1, wherein the visible images are transferred from said photoconductive belt to said intermediate transfer belt at a first transfer position and from said intermediate transfer belt to a recording medium at a second transfer position, a distance from said first transfer position to said second transfer position as measured on said intermediate transfer belt being greater than a maximum print size.

3. An apparatus as claimed in claim 2, wherein said intermediate transfer belt is provided with position information means for determining a time for forming the latent image on said photoconductive belt, said apparatus further comprising position information detecting means for detecting said position information means.

4. An apparatus as claimed in claim 3, wherein said position information means comprises a plurality of marks provided on a part of said intermediate transfer belt.

5. An apparatus as claimed in claim 4, wherein said time for forming the latent image is a time when one of said plurality of marks is sensed after a print enable state has been set up in said apparatus.

6. An apparatus as claimed in claim 5, further comprising:

storing means for storing a number of said marks beforehand when the visible images are to be superposed one above the other on said intermediate transfer belt;

counting means for counting said marks until said intermediate transfer belt completes one rotation; and mark discriminating means for discriminating said marks detected by said counting means for the first time from the others;

the latent image being again formed on said photoconductive belt on the basis of said marks detected for the first time.

7. An apparatus as claimed in claim 6, wherein a distance between nearby ones of said marks is less than the maximum print size.

8. A color image forming apparatus comprising:

a photoconductive belt;

latent image forming means for forming latent images each being representative of an image of particular color electrostatically on said photoconductive belt;

developing means for developing each of the latent images with a developer of particular color to thereby produce a corresponding visible image;

an intermediate transfer belt to which the visible images of respective colors are transferred from said photoconductive belt one above the other; and a drive transmission system comprising a first drive roller for driving said photoconductive belt, and a second drive roller for driving said intermediate transfer belt;

said intermediate transfer belt having a circumferential length which is an integral multiple of a circumferential length of said second drive roller, said circumferential length of said second drive roller being an integral multiple of a circumferential length of said first drive roller;

said intermediate transfer belt being provided with position information means for determining a time for forming the latent image on said photoconductive belt, said apparatus further comprising position information detecting means for detecting said position information means.

* * * * *

UNITED STATES PATENT AND TRADEMARK OFFICE

CERTIFICATE OF CORRECTION

PATENT NO. : 5,515,145

DATED : May 7, 1996

INVENTOR(S) : Eiichi SASAKI, et al.

It is certified that error appears in the above-indentified patent and that said Letters Patent is hereby corrected as shown below:

On the title page, Item [54], and column 1, the title should read:

--COLOR IMAGE FORMING APPARATUS HAVING INTEGRAL MULTIPLE LENGTH BELTS--

Signed and Sealed this

Thirteenth Day of August, 1996

*Attest:*

*Attesting Officer*

Bruce Lehman

BRUCE LEHMAN

*Commissioner of Patents and Trademarks*